US005443046A

United States Patent [19]

White

[11] Patent Number: 5,443,046

[45] Date of Patent: Aug. 22, 1995

[54] EFFICIENTLY PUMPED FUEL SUPPLY SYSTEM

[75] Inventor: Brian R. White, Stillwater, Okla.

[73] Assignee: Brunswick Corporation, Lake Forest, Ill.

[21] Appl. No.: 180,626

[22] Filed: Jan. 13, 1994

Related U.S. Application Data

[63] Continuation-in-part of Ser. No. 104,380, Aug. 9, 1993, Pat. No. 5,394,846, and a continuation-in-part of Ser. No. 104,439, Aug. 9, 1993, Pat. No. 5,400,750, and a continuation-in-part of Ser. No. 104,440, Aug. 9, 1993, Pat. No. 5,408,971.

[51] Int. Cl.[6] ..... F02D 3/02; F02M 37/08

[52] U.S. Cl. ..... 123/438; 123/497; 123/585

[58] Field of Search ..... 123/339, 472, 497, 498, 123/499, 585, 437, 438

[56] References Cited

U.S. PATENT DOCUMENTS

| | | | |
|---|---|---|---|
| 4,034,730 | 7/1977 | Ayres et al. | 123/499 |
| 4,048,964 | 9/1977 | Kissel | 123/497 |
| 4,522,176 | 6/1985 | Takao et al. | 123/339 |
| 4,643,147 | 2/1987 | Staerzl | 123/357 |
| 4,646,706 | 3/1987 | Emmenthal | 123/585 |
| 4,699,109 | 10/1987 | Hensel | 123/458 |
| 4,711,219 | 12/1987 | Staerzl | 123/494 |
| 4,732,131 | 3/1988 | Hensel | 123/516 |
| 4,750,464 | 6/1988 | Staerzl | 123/494 |
| 4,763,626 | 8/1988 | Staerzl | 123/438 |
| 4,777,913 | 10/1988 | Staerzl et al. | 123/73 A |
| 4,794,888 | 1/1989 | Lang | 123/73.5 C |
| 4,840,148 | 6/1989 | Staerzl | 123/73 A |
| 5,156,133 | 10/1992 | Sugimoto et al. | 123/585 |
| 5,237,975 | 8/1993 | Betki et al. | 123/497 |
| 5,241,938 | 9/1993 | Takagi et al. | 123/585 |
| 5,284,119 | 2/1994 | Smitley | 123/497 |
| 5,287,839 | 2/1994 | Kondou et al. | 123/497 |
| 5,339,785 | 8/1994 | Wilksch | 123/457 |

OTHER PUBLICATIONS

*Automotive Handbook*, 2nd Edition, Robert Bosch GmbH, Jan. 1986, pp. 366–369.

*Automotive Electric/Electronic Systems*, Robert Bosch GmbH, Jan. 1988, pp. 185–205.

*Automotive Fuel Injection Systems*, A Technical Guide, Jan P. Norbye, Motorbooks International Publishers, Osceola, Wis., Jan. 1988, pp. 92–99, 124–129.

*Bosch Fuel Injection & Engine Management*, Charles O. Probst, SAE, Robert Bentley Publishers, Cambrige, Massachusetts, Jan. 1989, Chapter 5.

*Primary Examiner*—Willis R. Wolfe

*Attorney, Agent, or Firm*—Andrus, Sceales, Starke & Sawall

[57] ABSTRACT

In a low pressure continuous flow fuel injection system for an internal combustion engine, an electric fuel pump (18) is energized with a variable duty cycle to vary the pumped volume output of the pump according to engine fuel requirements. The duty cycle is varied to energize the pump to pump substantially only the amount of fuel required by the engine, such that at idle or low engine speed, the pump is energized a lower percentage of the time than at high engine speed. Fuel flow through the fuel injector (12) is continuous, but energization of the pump is not, such that the pump is not pumping at full capacity when unneeded. An electric idle air control valve (54) is also energized with a variable duty cycle to vary the amount of bypass idle air supplied to the intake manifold (10).

8 Claims, 2 Drawing Sheets

EFFICIENTLY PUMPED FUEL SUPPLY SYSTEM

CROSS REFERENCE TO RELATED APPLICATIONS

This application is a continuation-in-part of application Ser. No. 08/104,380, filed Aug. 9, 1993, now U.S. Pat. No. 5,394,846, Ser. No. 08/104,439, filed Aug. 9, 1993, now U.S. Pat. No. 5,400,750, and Ser. No. 08/104,440, filed Aug. 9, 1993, now U.S. Pat. No. 5,408,971.

BACKGROUND AND SUMMARY

The invention relates to fuel injection systems for internal combustion engines.

Fuel injection systems for internal combustion engines are generally of two types. One type is a high pressure system wherein pressurized fuel is supplied to a high pressure precision fuel injector which emits fuel for combustion in the engine. A high pressure fuel injector is a costly, precision part and must be actuated between on (passing) and off (blocking) states. The other type of fuel injection system is a low pressure system wherein fuel continuously flows through a low pressure fuel injector. A low pressure fuel injector is simple and inexpensive and is not actuated between on and off states, but rather is on all the time and continuously passes fuel therethrough. The present invention relates to the latter type fuel injection system.

The present invention provides improvements in continuous flow fuel injection systems, including reduced fuel heating, reduced wear, longer service life, simplification, and reduced number of parts. An electric fuel pump is energized with a variable duty cycle to vary the pumped volume output of the pump according to engine fuel requirements. This is particularly advantageous in applications where the engine is operated at idle or low speeds for extended durations because the pump is not continuously running and heating the fuel. The duty cycle is varied to energize the pump to pump substantially only the amount of fuel required by the engine, such that at low engine speed, the pump is energized a lower percentage of the time than at high engine speed. This reduces pump wear. Fuel flow through the fuel injector is continuous but energization of the pump is not. The pump is not pumping at full capacity when unneeded. This increases service life. Part content is reduced by eliminating the need for a solenoid or other metering device at the fuel injector inlet.

DETAILED DESCRIPTION

Figure 1:
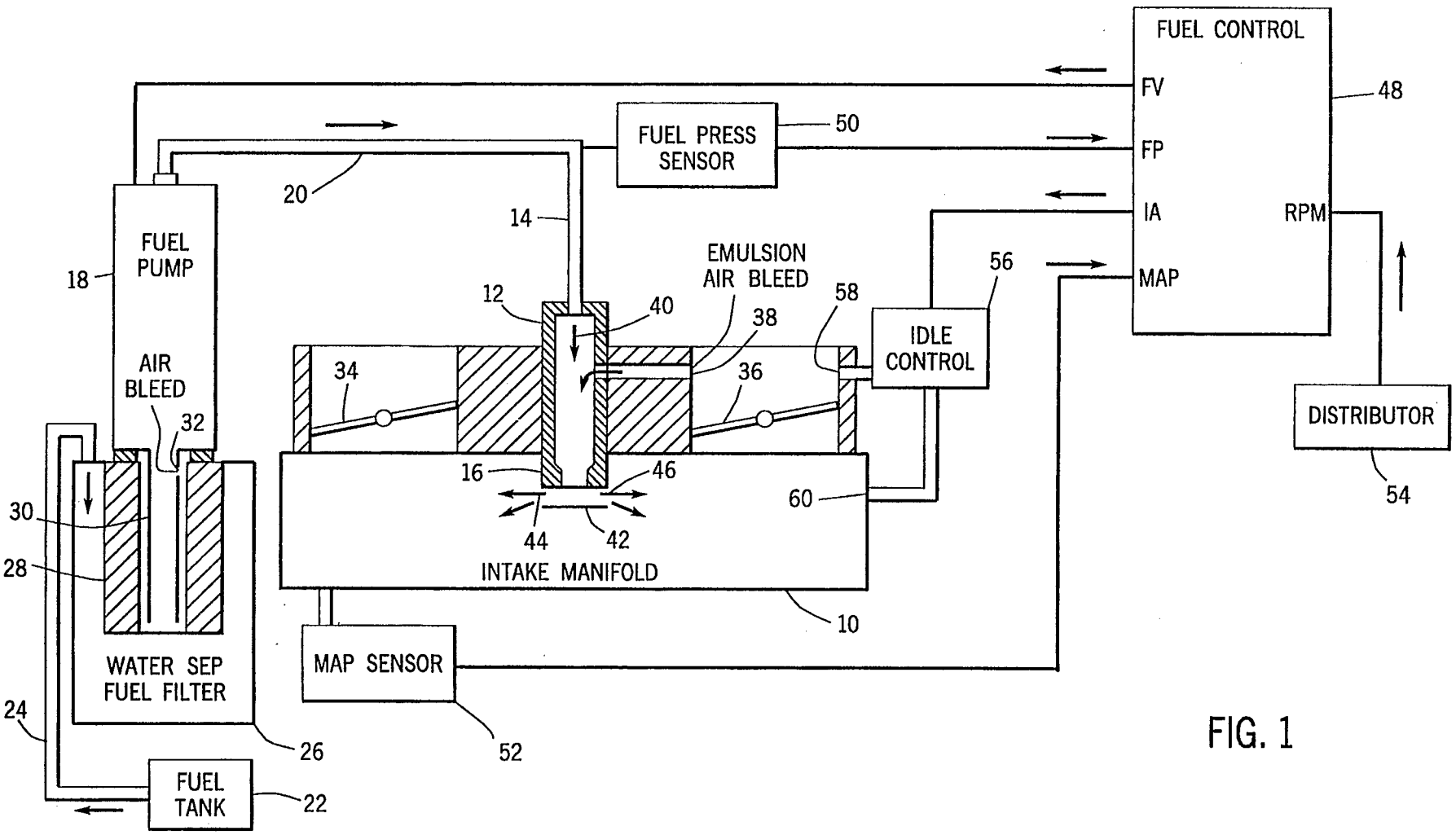
FIG. 1 is a schematic illustration of a fuel injection system in accordance with the invention.

FIG. 1 shows a fuel injection system for supplying fuel to an intake manifold 10 of an internal combustion engine. A low pressure continuous flow fuel injector 12 has an inlet 14 receiving fuel, and an outlet 16 supplying fuel to intake manifold 10. Fuel injector outlet 16 is in continuous communication with fuel injector inlet 14. Electric fuel pump 18 supplies fuel to fuel injector inlet 14 through fuel line 20. Fuel pump 18 draws fuel from fuel tank 22 through fuel line 24 into housing 26 having a water separating fuel filter 28. A standpipe 30 extends downwardly from the fuel pump into the housing to draw fuel from below the liquid level to minimize admission of air, though a small air bleed 32 is provided near the top of the standpipe to allow escape of air into the combustion system which may have become trapped during filter changes or due to air leaks or the like.

Combustion air is supplied through one or more throttle controlled butterfly valves 34 and 36. An emulsion air bleed 38 communicates with the fuel injector between inlet 14 and outlet 16 and entrains air into the fuel passing through the fuel injector to help breakup the fuel prior to being released into the intake manifold. Fuel is supplied from fuel injector inlet 14 to fuel injector outlet 16 along a longitudinal axis 40. The fuel injector outlet has an end cap 42 with a plurality of discharge ports such as 44, 46 emitting fuel from the outlet transversely of axis 40.

Fuel pump 18 is energized with a variable duty cycle from fuel control module 48 to vary the pumped fuel volume (FV) output of pump 18 according to engine fuel requirements. The duty cycle is varied to energize pump 18 to pump substantially only the amount of fuel required by the engine, such that at idle or low engine speed, the pump is energized a lower percentage of the time than at high engine speed. Fuel flow through fuel injector 12 is continuous, but energization of pump 18 is not. Pump 18 is not pumping at full capacity when unneeded. The duty cycle of energization of pump 18 is varied according to the difference between the fuel pressure (FP) at fuel injector inlet 14 sensed by fuel pressure sensor 50, and the manifold absolute pressure (MAP) in intake manifold 10 sensed by MAP sensor 52 and according to engine speed, revolutions per minute (RPM), as provided by distributor 54.

An idle air control valve 56, preferably a solenoid valve, has an inlet 58 communicating with ambient air, and an outlet 60 communicating with the intake manifold. Valve 56 has an open condition providing communication between inlet 58 and outlet 60 and supplying bypass idle air (IA) to intake manifold 10 for idle, and has a closed condition blocking communication between inlet 58 and outlet 60. Idle air control valve 56 is also energized with a variable duty cycle to vary the amount of bypass idle air supplied to intake manifold 10. In the preferred embodiment, the duty cycle of idle air control solenoid valve 56 is varied according to engine speed, i.e. revolutions per minute (RPM), as provided by distributor 54. In the preferred embodiment, the idle air control solenoid valve is mounted in passage 46 of above noted U.S. Pat. No. 5,394,846 and replaces stepper motor 47.

Figure 2:
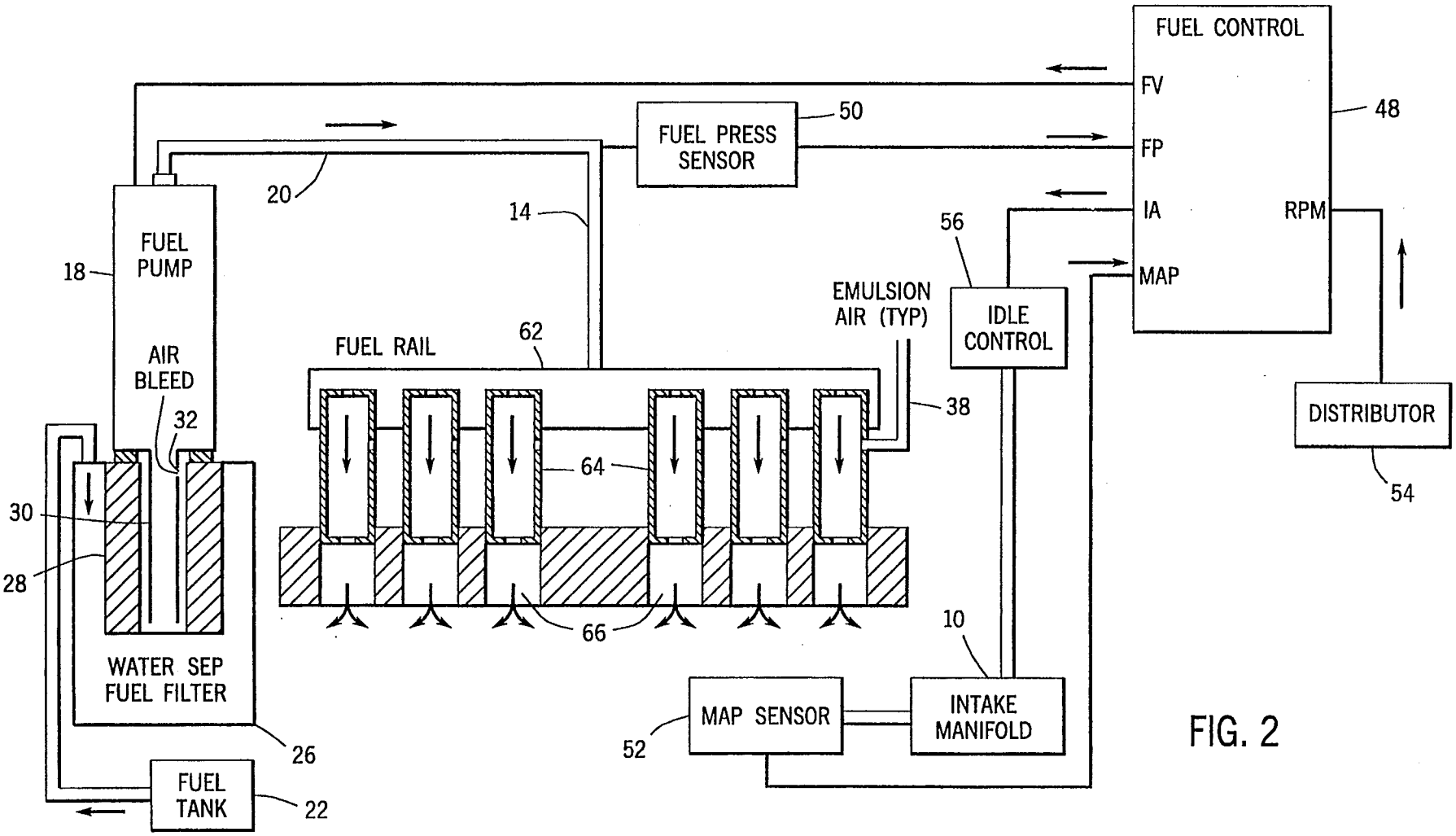
FIG. 2 is a schematic illustration like FIG. 1 and shows a further embodiment.

FIG. 2 is like FIG. 1 and uses like reference numerals where appropriate to facilitate understanding. Fuel line 14 is connected to fuel rail 62, for example as shown in above noted U.S. Pat. No. 5,408,971, which supplies fuel to a plurality of low pressure continuous flow fuel injectors 64 which supply fuel to respective fuel intake runners 66, for example as shown in above noted U.S. Pat. No. 5,400,750, which supplies fuel to the intake manifold. In FIG. 2, there is typically one fuel intake runner per cylinder, and one fuel injector per runner. In FIG. 1, there may be multiple fuel injectors supplying fuel directly to the intake manifold. In the preferred embodiments, the fuel injection systems of FIGS. 1 and 2 are used with four cycle engines, though the invention is also applicable to two cycle engines.

It is recognized that various equivalents, alternatives and modifications are possible within the scope of the appended claims.

I claim:

1. A method for supplying fuel to an internal combustion engine having an intake manifold, comprising providing a continuation flow fuel injector with an inlet receiving fuel, and an outlet supplying fuel to said intake manifold, said fuel injector outlet being in continuous communication with said fuel injector inlet, providing an electric fuel pump supplying fuel to said fuel injector inlet, and energizing said fuel pump with a variable duty cycle to vary the pumped volume output of said pump according to engine fuel requirements, varying said duty cycle to energize said pump to pump substantially only the amount of fuel required by said engine, such that at low engine speed, said pump is energized a lower percentage of the time than at high engine speed, and such that fuel flow through said fuel injector is continuous, but energization of said pump is not, such that said pump is not pumping at full capacity when unneeded, supplying fuel from said fuel injector inlet to said fuel injector outlet along a longitudinal axis, and emitting fuel from said fuel injector outlet transversely of said longitudinal axis.

2. The method according to claim 1 comprising varying said duty cycle of energization of said pump according to the difference between the pressure at said fuel injector inlet and the pressure in said intake manifold.

3. The method according to claim 2 comprising varying said duty cycle of energization of said pump according to engine speed.

4. The method according to claim 1 comprising providing an emulsion air bleed communicating with said fuel injector between said fuel injector inlet and said fuel injector outlet and entraining air into the fuel passing through said fuel injector to help breakup the fuel prior to being released into said intake manifold.

5. A fuel injection system for an internal combustion engine having an intake manifold, comprising a continuous flow fuel injector with an inlet receiving fuel, and an outlet supplying fuel to said intake manifold, said fuel injector outlet being in continuous communication with said fuel injector inlet, a variable duty cycle energized electric fuel pump supplying variable volume pumped fuel to said fuel injector inlet according to engine fuel requirements, wherein said duty cycle is varied to energize said pump to pump substantially only the amount of fuel required by said engine, such that at low engine speed, said pump is energized a lower percentage of the time than at high engine speed, and such that fuel flows through said fuel injector continuously, but said pump is not continuously energized, such that said pump is not pumping at full capacity when unneeded, said fuel is supplied from said fuel injector inlet to said fuel injector outlet along a longitudinal axis, and wherein said fuel injector outlet has a plurality of discharge ports emitting fuel transversely of said longitudinal axis.

6. The system according to claim 5 wherein said duty cycle of energization of said pump is varied according to the difference between the pressure at said fuel injector inlet and the pressure in said intake manifold.

7. The system according to claim 6 wherein said duty cycle of energization of said pump is varied according to engine speed.

8. The system according to claim 5 further comprising in combination an emulsion air bleed communicating with said fuel injector between said fuel injector inlet and said fuel injector outlet and entraining air into said fuel passing through said fuel injector to help breakup the fuel prior to being released into said intake manifold.

* * * * *